United States Patent [19]

Auerbach et al.

[11] 4,205,732

[45] Jun. 3, 1980

[54] MUFFLER FOR PORTABLE PNEUMATIC TOOL

[75] Inventors: Edward I. Auerbach, Belle Mead, N.J.; Lewis C. Pritchard, San Jose, Calif.; John M. Clapp, Sayre, Pa.

[73] Assignee: Ingersoll-Rand Company, Woodcliffe Lake, N.J.

[21] Appl. No.: 18,143

[22] Filed: Mar. 7, 1979

[51] Int. Cl.[2] ..... F01N 1/10

[52] U.S. Cl. ..... 181/230; 181/258; 181/275

[58] Field of Search ..... 181/230, 275, 281, 258; 173/DIG. 2, 169

[56] References Cited

U.S. PATENT DOCUMENTS

| | | | |
|---|---|---|---|
| 1,575,657 | 3/1926 | Straussler | 181/258 |
| 1,666,257 | 4/1928 | Furnivall et al. | 181/258 |
| 2,950,775 | 8/1960 | Zwayer | 181/230 |
| 3,384,200 | 5/1968 | Baker et al. | 181/230 |
| 3,880,245 | 4/1975 | Anderson, Jr. | 181/230 |
| 3,993,159 | 11/1976 | Amador | 181/230 |

FOREIGN PATENT DOCUMENTS

| | | | |
|---|---|---|---|
| 2355203 | 1/1975 | Fed. Rep. of Germany | 181/281 |
| 291875 | 6/1928 | United Kingdom | 181/258 |

*Primary Examiner*—L. T. Hix
*Assistant Examiner*—Benjamin R. Fuller
*Attorney, Agent, or Firm*—Walter C. Vliet

[57] ABSTRACT

The invention relates to a muffler for portable pneumatic tools wherein the exhaust of the pneumatic motor is passed into an expansion chamber having a perforated outlet baffle biased to the direction of the flow in the chamber. The flow from the expansion chamber enters a muffler chamber having an outlet baffle also biased to the direction of fluid flow. Both the first and second baffle are formed in an end cap for the handle of the pneumatic tool and form a removable extension thereof.

14 Claims, 5 Drawing Figures

BIAS
FLOW

MUFFLER FOR PORTABLE PNEUMATIC TOOL

BACKGROUND OF THE INVENTION

This invention relates to a pneumatic hand tool and more particularly to a pneumatic hand tool incorporating means for muffling the exhaust noise characteristic of such hand tools. Pneumatic hand tools normally incorporate a rotary vane-type motor which is driven by air pressure. When these motors exhaust directly to atmosphere, such as through radial slots incorporated in the housing, a characteristically high pitched whine results.

A number of these tools operated simultaneously can create an uncomfortable noise level. Add-on mufflers are cumbersome and generally interfere with tool operation. Attempts to pipe away exhaust gases have proven cumbersome and otherwise not totally satisfactory. To date, mufflers incorporated in the handles of the tools have not proven entirely satisfactory for either economic reasons of construction or insufficient noise reduction capability.

SUMMARY OF THE INVENTION

An object of the present invention is to provide a muffler for portable power tools which is economical to manufacture and provides the desired degree of noise reduction for a portable pneumatic tool. Another object of the present invention is to provide a muffler which is easily replaceable and which may be manufactured from a plastic material or the like.

A further object of the invention is to provide noise reduction by means of a baffle placed in the exit of an exhaust expansion chamber wherein the baffle lies at an angle biased to the direction of flow and thereby a varying length of the expansion chamber is provided.

Yet a further object of the invention is to provide a muffler chamber having an outlet biased to the direction of flow and further biased at an angle to the outlet baffle of the expansion chamber. The muffler chamber may be packed with a sound absorbing material and at least a portion of the muffler may form an extension of the handle.

DESCRIPTION OF THE PREFERRED EMBODIMENT

Figures 1, 2, 3:
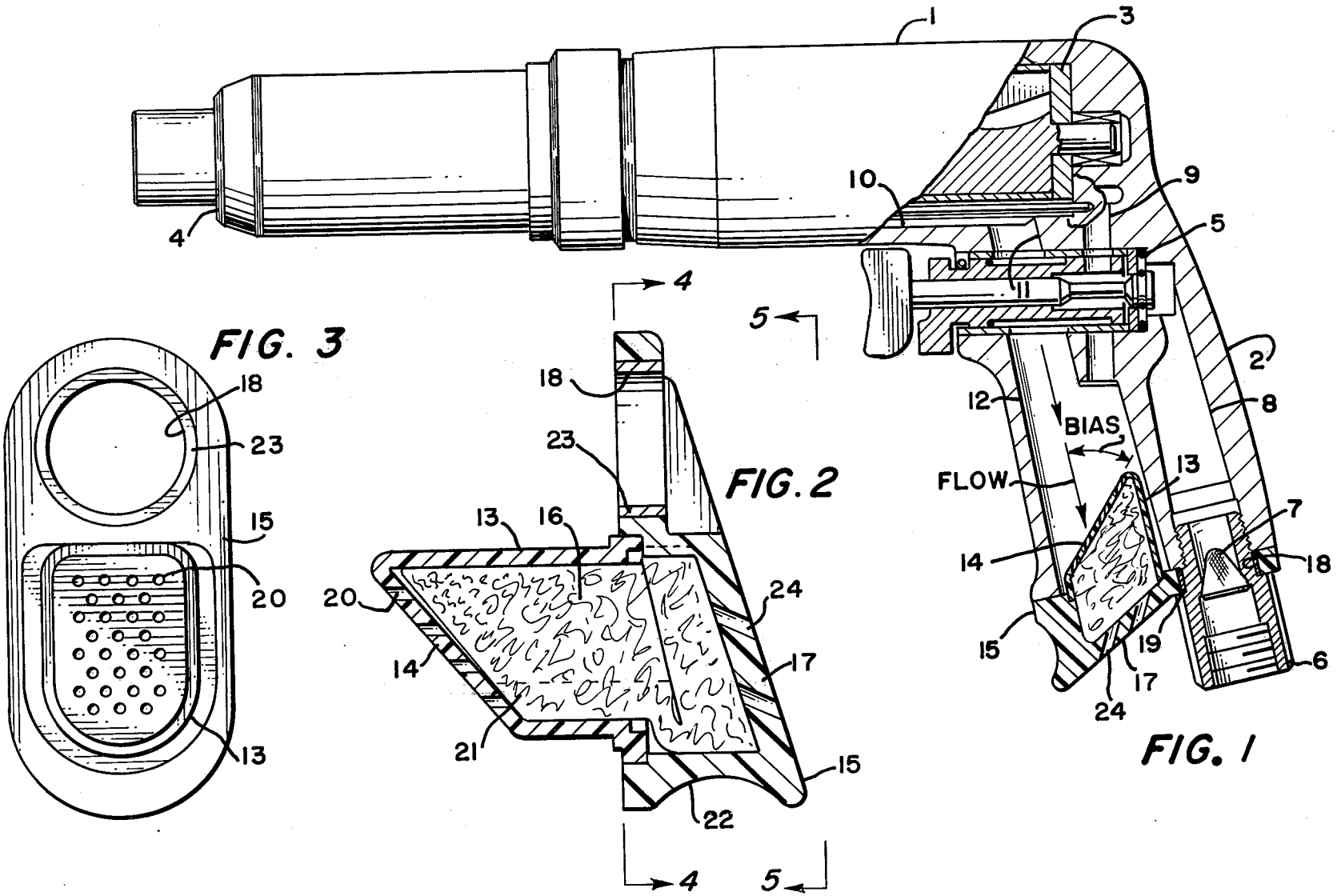
FIG. 1 is a side elevational view, partly in section of a pneumatic drill including the expansion chamber and muffler of the present invention.
FIG. 2 is an enlarged sectional view illustrating the details of construction of the muffler.
FIG. 3 is an end view of the inlet side of the muffler as viewed from left to right in FIG. 2.

Referring to FIG. 1, a pneumatically driven screwdriver is shown generally by reference numeral 1. The housing of the screwdriver is provided with a handle 2 for convenient gripping of the screwdriver. The housing contains a pneumatically operated motor 3 (partly shown). The motor might drive a series of reduction gears (not shown) which in turn would drive the screwdriver blade collet 4 through possibly a torque limiting device, such as a clutch (not shown).

Typically screwdrivers of this type are provided with an on/off valve and where desired, a reversing means. In the preferred embodiment shown, a trigger operated spool type on/off reversing valve 5 is shown. It is sufficient for purpose of this disclosure to understand that the on/off reversing valve 5 is utilized to control the air flow to the motor 3 and further to determine the direction of rotation of the motor. Pneumatic pressure fluid enters the screwdriver by means of a hose (not shown), which is attached to the inlet bushing 6, which is provided with a filter screen 7.

Air entering the screwdriver flows through passageway 8 to the on/off reversing valve 5 where it is distributed to the motor 3 by at least motor inlet passage 9. The pressure fluid is expanded in the motor 3 to produce the required work of rotating the screwdriver. After the pressure fluid is expanded in the motor, it is discharged into motor exhaust chamber 10. The exhaust pressure fluid then passes through motor exhaust passageway 11 through the on/off reversing valve 5 and into exhaust expansion chamber 12. In the preferred embodiment, the exhaust expansion chamber is located in the handle 2 of the screwdriver. The direction of flow through the expansion chamber and to the exit of the tool is generally indicated by the exhaust flow arrow shown.

Inserted in the exhaust expansion chamber 12 in a first muffler element 13, which is essentially cup-shape. The bottom of the first muffler element 13 is perforated and forms a first baffle element 14, which will be described more fully later. The first muffler element 13 is inserted in and cooperates with a second muffler element 15 to form a muffler chamber 16. The second muffler element 15 is perforated to form an exit from the muffler chamber 16. The perforations form a second baffle element 17.

The second muffler element 15 forms both an end cap and an extension to the handle, and further forms a seal for exhaust expansion chamber 12 and also passageway 8. The second muffler element 15 is attached to the handle by means of the inlet bushing 6 extending through a bore 18 in the second muffler element 15 and the threaded connection of the inlet bushing 6 in the passageway 8 of the handle 2. A shoulder 19 on inlet bushing 6 presses against the second muffler element 15 to retain it in place.

FIG. 2 shows the detail of the first and the second muffler element forming the muffler for the screwdriver of the present embodiment. As previously described, the first baffle 14 is provided with a series of passageways or perforations 20 which allows the exhaust pressure fluid to enter the muffler chamber 16. The pattern of the perforations may best be seen on FIG. 3.

The muffler chamber may be filled with an acoustic absorbing packing 21, such as aluminum oxide fiber mat or the like.

The second muffler element 15 forms an extension of the handle 2 and is provided with a finger recess 2 which aids in the grip of the handle. The second muffler element is provided with reenforcing bushing 23 in the bore 18 to prevent crushing of the element, which in the preferred embodiment is manufactured from a plastic material for ease and economy of manufacture and for the sound absorbing properties thereof. The second muffler element 15 is provided with a series of perforations 24 which are formed in the second baffle element 17.

In the first muffler element, the first baffle element 14 is placed at an angle which is biased to the direction of exhaust flow. This creates an exhaust expansion chamber having variable exhaust path length. The reason for this will be more fully described later.

Figure 4:
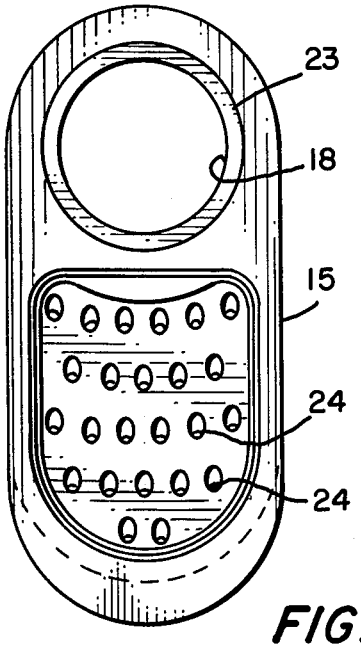
FIG. 4 is a partially sectioned end view of the muffler taken through Section 4—4 as shown on FIG. 2.
Figure 5:
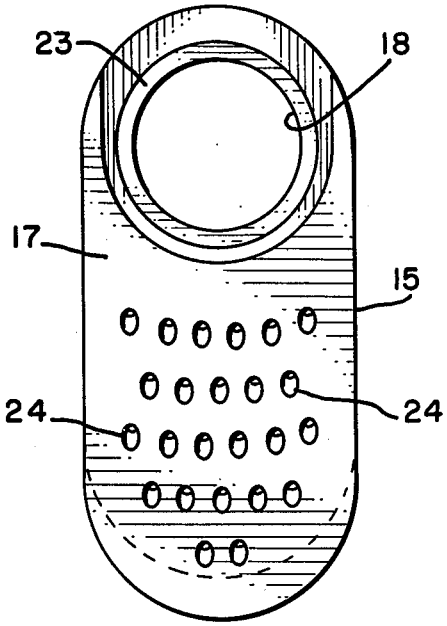
FIG. 5 is an end view of the outlet side of the muffler as viewed from right to left in FIG. 2.

In addition, the second baffle element is biased to both the direction of exhaust flow and the first baffle element 14. This creates a muffler chamber having a different flow length for exhaust pressure fluid. In addition, the perforations 24 in the second baffle element 17 are biased to the direction of flow and to the plane of the second exhaust baffle. The pattern of the perforations in the second baffle element 17 can best be seen on FIG. 4 and FIG. 5.

It has been found that the angle of bias to the direction of flow may be varied, depending on the frequency of the noise, to obtain optimum attenuation of the sound. The useful range is believed to be from about 10 to 80 degrees. In the present embodiment, the first baffle element 14 is set at approximately 50 degrees to the direction of exhaust flow. The second baffle element 17 is set at approximately 75 degrees and its perforations are set at approximately 25 degrees to the the direction of the exhaust flow. The perforations in the first baffle element are not biased in the embodiment to produce smooth flow within the muffler.

The perforations 24 in the second muffler element are biased to direct the fluid away from hoses, clamps and other rigid structure. This reduces the radiation efficiency of the broad band noise sources and thus reduces the overall noise produced by the tool. The perforations 24 are sized to put the peak frequency of the broad band noise beyond the audible range. In addition, the perforations are spaced so that the outer jets form a barrier to the inner perforations reducing the overall noise level.

By way of background in explaining the operation of the unique muffler of this invention, it should be understood that noise generated by pneumatically driven vane motors is characterized as a series of discrete narrow band random or deterministic tones which have frequencies that are multiples of rotational speed. In addition, broad band noise is generated external to the motor by the shearing action of the high velocity exhaust spewing into the quiescent atmosphere.

It is desirable to reduce noise generated by both sources with an internal muffler that affects motor performance as little as possible. Known internal mufflers use resistive materials to impede the flow and dissipate upstream noise into heat. However, these mufflers create high back pressures. Therefore, it is the purpose of this invention to muffle the noise internally with lower back pressures than can be attained by known designs.

The present muffler uses the fact that a periodic noise signal such as generated by vane passage of an air motor is based on the summation of many periodic noise signals of the same frequency and amplitude and that the resultant sound level is dependent on the phase relationship between the individual signals. The present muffler separates the exhaust and the upstream noise into many separate paths. The porous exit plate of the muffler is biased with respect to the direction of flow. Therefore, path lengths vary across the face of the muffler creating a phase difference between the various signals exiting from the muffler. Hence, cancellation takes place and motor noise is reduced. The motor noise attenuation is enhanced by the use of resistive and reactive elements upstream of the muffler exit plate.

When the working fluid exits from the cylinders of a pneumatic motor, it usually enters an exhaust duct or expansion chamber immediately upstream of the muffler. If the dimensions of this chamber are such that standing waves occur within it, then the performance of the muffler will be reduced. Therefore, a resistive baffle plate, such as the first baffle plate described above, is placed in the duct with the baffle plate biased with respect to the flow. This eliminates the possibility of standing waves in the duct.

Having described the invention in terms of the preferred embodiment, it will now be obvious to one skilled in the art that numerous modifications are possible within the principals outlined. We do not wish to be limited in the scope of our invention except by the following claims.

I claim:

1. A muffler for portable pneumatic power tools or the like which exhaust pneumatic fluid to atmosphere comprising:

an enclosure attached to the power tool forming a muffler chamber receiving the exhaust pneumatic fluid;

a first perforated baffle plate forming one wall of said enclosure for passing the exhaust pneumatic fluid into said muffler chamber;

a second perforated baffle plate opposite said first perforated baffle plate forming a second wall of said enclosure for passing the exhaust pneumatic fluid in one direction of fluid flow through said enclosure and said muffler chamber and out of said muffler chamber to the atmosphere; and said second perforated baffle is set at an angle biased to the direction of exhaust pneumatic fluid flow through said muffler chamber, and at an angle biased to said first perforated baffle plate.

2. A muffler according to claim 1 wherein:

said first baffle plate is set at an angle biased to the path of exhaust pneumatic fluid flow through said muffler chamber.

3. A muffler according to claim 1 wherein:

said muffler chamber is packed with an acoustic absorbing material.

4. A muffler according to claim 1 wherein:

the perforations of said second baffle are set at an angle biased to said direction of the exhaust pneumatic fluid flow and the perpendicular to plane of said second baffle.

5. A muffler according to claim 1 wherein:

said second perforated plate is set at an angle between 10 and 80 degrees to the direction of exhaust pneumatic fluid flow.

6. A muffler according to claim 2 wherein:

said first perforated plate is biased at an angle of between 10 and 80 degrees to the direction of exhaust pneumatic fluid flow.

7. A muffler according to claim 4 wherein:

said perforations of said second baffle are biased at an angle of between 10 and 80 degrees to the direction of exhaust pneumatic fluid flow.

8. The muffler according to claim 1 wherein:

a portion of said enclosure for said muffler chamber forms an gripping extension of a handle of said portable pneumatic power tool.

9. A muffler according to claim 1 wherein:

said muffler is constructed of plastic material.

10. A muffler according to claim 8 wherein:

said muffler is mounted to said handle by means of an inlet air bushing threadingly connected to said handle.

11. A muffler according to claim 8 wherein:

said muffler forms an end cap to said handle.

12. A muffler for portable pneumatic power tools or the like which exhaust pneumatic fluid to atmosphere comprising:

a muffler enclosure forming a muffler chamber installed in the exhaust expansion chamber of a portable pneumatic power tool for receiving the exhaust pneumatic fluid;

a first perforated plate at one end of said enclosure set at an angle biased to the direction of pressure fluid flow at an angle of between 30 and 60 degrees to the direction of exhaust pneumatic fluid flow for passing the exhaust pneumatic fluid into said muffler chamber;

a second perforated baffle plate at another end of said enclosure for passing the exhaust pneumatic pressure to said muffler chamber to atmosphere set at an angle of between 60 and 80 degrees to the direction of exhaust pneumatic fluid flow; and wherein said first and said second perforated baffle are set at a different angle biased to the direction of pressure fluid flow.

13. A muffler according to claim 12 wherein:

said second perforated baffle is provided with perforations which are biased to the direction of fluid flow.

14. A muffler according to claim 12 wherein:

said muffler chamber is packed with aluminum oxide fiber mat.

* * * * *